United States Patent [19]

Price

[11] Patent Number: 4,481,858

[45] Date of Patent: Nov. 13, 1984

[54] SINGLE BARREL EXTERNALLY POWERED GUN

[75] Inventor: Leonard W. Price, Marina Del Rey, Calif.

[73] Assignee: Hughes Helicopters, Inc., Culver City, Calif.

[21] Appl. No.: 479,659

[22] Filed: Mar. 28, 1983

Related U.S. Application Data

[60] Division of Ser. No. 303,705, Sep. 18, 1981, Pat. No. 4,418,607, which is a continuation of Ser. No. 789,502, Apr. 21, 1977, abandoned, which is a continuation of Ser. No. 418,356, Nov. 23, 1973, abandoned.

[51] Int. Cl.[3] ..... F41D 5/00; F41D 10/06

[52] U.S. Cl. ..... 89/11; 89/185; 89/33.25

[58] Field of Search ..... 89/1 R, 1 K, 1 L, 9, 89/11, 33 BA, 33 BB, 33 C, 33 CA

[56] References Cited

U.S. PATENT DOCUMENTS

| | | | |
|---|---|---|---|
| 1,056,602 | 3/1913 | Steinocher | 89/1 R |
| 1,248,537 | 12/1917 | Orkin | 89/1 R |
| 1,290,842 | 1/1919 | Mottin | 89/11 |
| 1,335,839 | 4/1920 | Johnston | 89/33 BA |
| 2,091,672 | 8/1937 | Cleereman | 89/33 BA |
| 2,815,699 | 12/1957 | Davis | 89/33 CA |

FOREIGN PATENT DOCUMENTS

| | | | |
|---|---|---|---|
| 495712 | 10/1919 | France | 89/33 BB |

*Primary Examiner*—Stephen C. Bentley
*Attorney, Agent, or Firm*—Beehler, Pavitt, Siegemund, Jagger & Martella

[57] ABSTRACT

A single barrel externally powered gun includes a feed mechanism, a bolt assembly, a bolt control assembly and a power transmission system. The bolt control assembly is in the form of a chain drive unit driven continuously along a predetermined path of travel which defines the timing and sequence of loading, ramming, firing and ejecting. The chain drive assembly controls the reciprocating motion of the bolt assembly relative to a fixed non-rotating and non-reciprocating barrel, the bolt being stationary in the firing and loading sequences. The feed mechanism which continuously advances rounds is integrated to the intermittent motion of the bolt by a Geneva wheel mechanism, as the bolt assembly reaches the proper position in its rearward movement. Bolt locking, firing and unlocking are all controlled, and carried on while the chain drive assembly is continuously moving. In another form, a parallel index drive assembly may be used in place of a Geneva wheel mechanism with resultant simplification of the overall gun structure. A power transmission system operates to effect synchronous movement of the feed and bolt control assemblies. Rates of fire of between 500 and 1000 rounds for a single barrel weapon are possible, with increased total rates if multiple barrel guns are provided.

47 Claims, 12 Drawing Figures

49
51
46
62
35
116
60
21
47
20
114
40
57
108
141
107
57a
106
81
45
82
86
90
51
50
81
77
81
83
96
97
85
84
55
95

160
162
173
163
170
62
60
178
177
176
180
175
163
166
165

SINGLE BARREL EXTERNALLY POWERED GUN

This is a division of application Ser. No. 303,705 filed Sept. 18, 1981, now U.S. Pat. No. 4,418,607 which in turn is a continuation of application Ser. No. 789,502 filed Apr. 21, 1977, now abandoned which in turn is a continuation of application Ser. No. 418,356 filed Nov. 23, 1973, now abandoned.

BACKGROUND OF THE INVENTION

1. Field of the Invention

This invention relates to medium rate of fire armaments and more particularly to an improved externally powered automatic gun of comparatively low weight and of relatively simple and reliable design, particularly adaptable for use on aircraft, and method of operating the same.

2. Description of the Prior Art

Single barrel externally powered gun systems are known and are characterized by complicated mechanisms and sequences for the firing cycle which usually includes loading, locking, firing, unlocking, and ejecting the spent round. Where rates of fire of 500 to 1000 rounds per minute per barrel are needed, the weapons heretofore designed are either of the Gatling gun variety, i.e. multiple barrels rotated into a battery position, or a single barrel which is cycled in a reciprocating type of movement into and out of a battery position. In each case, the systems are relatively complex and expensive because of the relatively large number of moving parts and the necessity to move the barrels.

When a Gatling system is used, there is a varying tangential velocity imparted to the projectile because of start-up, firing, or changing the barrel cluster's rate of fire. Additionally, in a Gatling mechanism the barrels are generally pointed inward at the muzzle end and variations in the angular position of the barrel at the moment of firing result in different impact points.

In the case of cycled barrel armament and a Gatling-type armament, a considerable mass must be moved and overall, the system provides a relatively large profile, a factor which may be of significance in instances of airborne use. For example, aerodynamic drag, weight and complexity of mechanism are factors when such weapons are to be used as armaments in armed helicopter mountings. The moving barrels of prior art systems has also created problems because of the infrared signature of high rate of fire weapons and the difficulty of effectively insulating the barrels, the principal infrared source.

Thus, a simple relatively inexpensive and reliable gun system of the externally powered type, which is simple in operation, offers advantages, especially for airborne use. By this invention, a gun system is provided which is lighter in weight, has reduced profile for lowered aerodynamic drag, is comparatively inexpensive and is as reliable as the prior art systems. Moreover, the gun system of this invention offers the additional advantages of shorter time to reach full rate of fire, long firing burst capability, prevention of double round feeding and safety against "cook off", i.e. firing due to presence of a round in a heated firing chamber. These advantages are achieved by a gun having substantially less parts than the prior art systems e.g. those gun systems known as the XM-188 and XM-140. Moreover, the sequence and timing of the gun function is controlled in a novel manner by an improved control mechanism.

SUMMARY OF THE INVENTION

The gun of the present invention includes five principal functional assemblies e.g. a chain drive or bolt control assembly, a bolt assembly, barrel assembly, a feeder assembly and a power transmission system.

In its simplest form, the system is an externally powered mechanism in which the gun barrel is fixed in the sense that it does not cycle or rotate. The unique, compact and reliable chain driven breech mechanism provides a low weight, small profile gun system usable on aircraft and capable of reaching the maximum fire rate in a very short time. The sequence of firing is fairly simple since interfacing gun barrel cycling is eliminated. Timing functions are positively controlled and with variation of timing is possible so that essentially the same type of control mechanism may be used for various types of ammunition. This simple and reliable mechanism offers unique advantages in the design of externally powered weapons, and especially simplify the sequence of operations i.e. the method and mode of operation in what is normally considered a relatively complex mechanism.

Of particular significance in the armament of the present invention is the arrangement of a constant velocity feed mechanism cooperating with a bolt having an intermittent motion, the constant velocity feed arrangement being integrated to the intermittent bolt motion by a positively driven intermittent motion assembly in the form of a cam indexing assembly such as a Geneva wheel or a parallel index drive preferably of the paradromic cam indexing type. Due to this type of arrangement, there is positive control of the round through the loading, ramming, firing and ejecting sequence, a definite advantage as will be described hereafter.

DESCRIPTION OF THE PREFERRED EMBODIMENT

Figure 1:
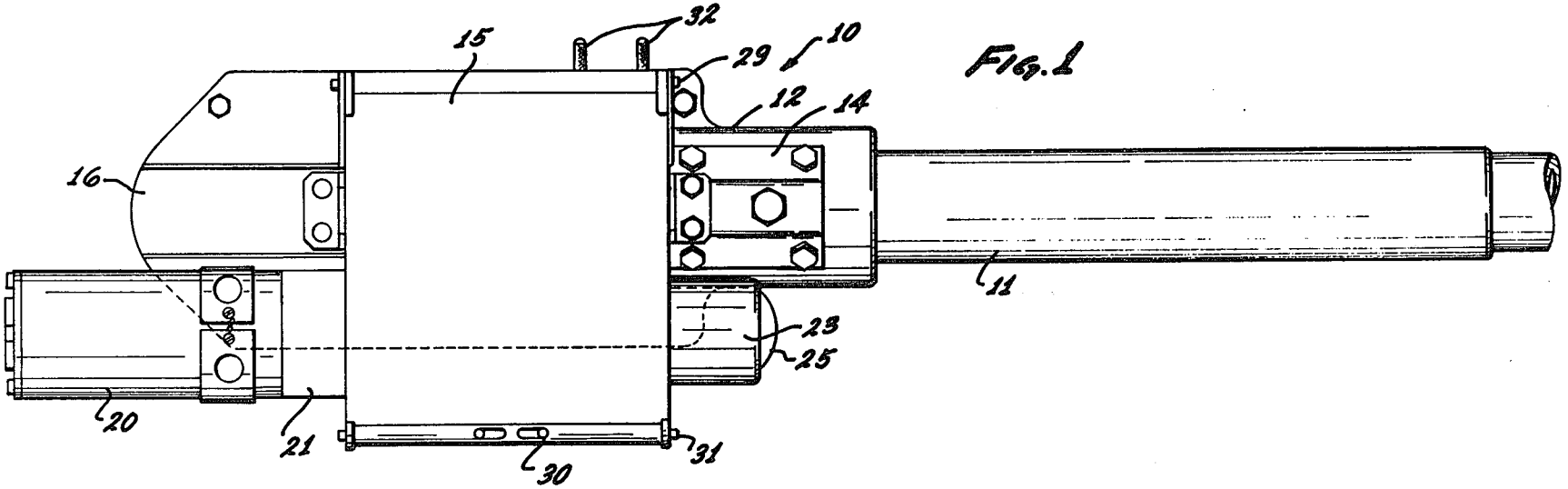
FIG. 1 is a plan view of the chain gun of the present invention.

Referring to FIG. 1 which illustrates an exemplary embodiment of the present invention, the gun 10 includes a barrel 11 supported within a receiver assembly 12, the latter including a feed rotor support assembly 14. Rearwardly of the support assembly 14 is a feed cover assembly generally designated 15 and a back cover 16.

Figure 2:
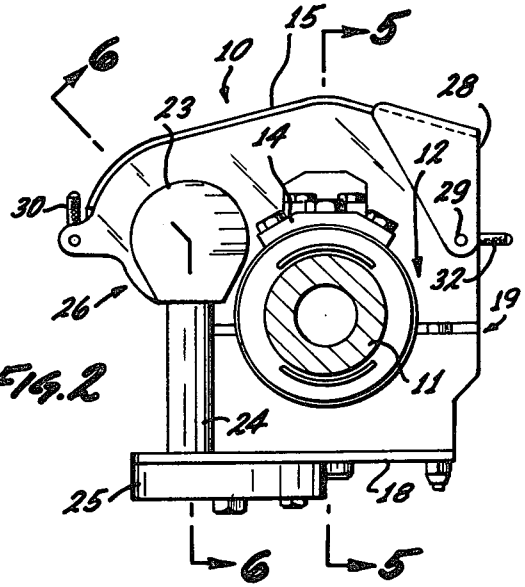
FIG. 2 is a front view of the gun of FIG. 1.
Figure 3:
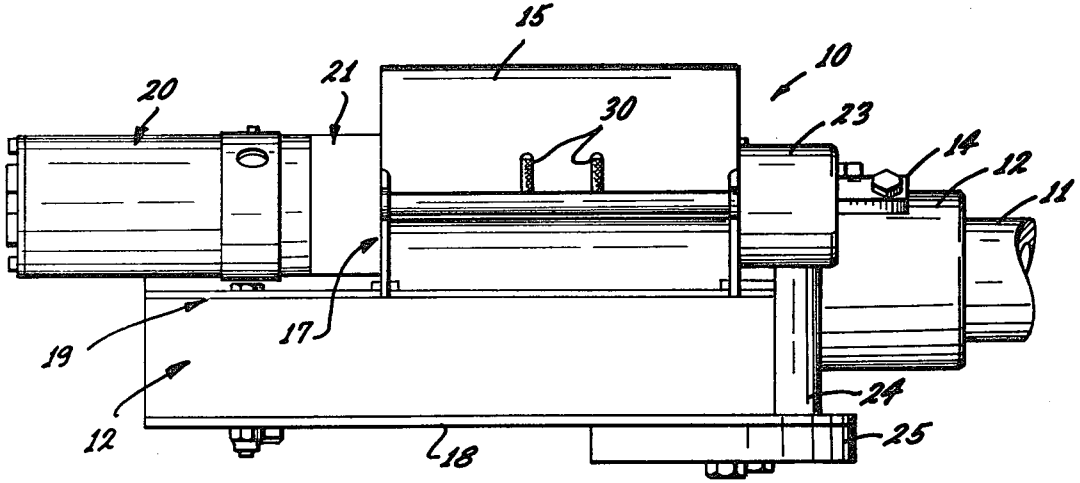
FIG. 3 is a side view of the gun shown in FIG. 1.

The receiver assembly 12, as illustrated in FIGS. 2 and 3, is positioned between a bottom plate 18 and a top plate assembly 19. Mounted to the rear feeder plate assembly 17 is the motor assembly 20 which includes a gear reducer 21 having concentrically arranged output drive shafts, as will be described. Forward of the feed cover assembly is a bevel gear housing 23 connected by a hollow tube cover 24 to a spur gear housing 25 mounted on the bottom plate 18 as indicated.

The motor assembly 20 and the gear reducer 21 provide primary power and basic timing for the various gun functions. The motor may be of a 3 horsepower 28 volt d.c. type with the nominal speed of 7000 rpm. Preferably, the motor incorporates both a mechanical spring applied and electrically released disc brake, and a dynamic electric brake, the functions of which will be described hereinafter.

The in-feed side of the feed cover assembly is indicated at 26, while links and spent cartridges are ejected through the out-feed side 28. The feed cover assembly 15 is hinged as indicated at 29, and by squeezing together pins 30, pins 31 are removed from their holes and the cover may be rotated about pivot 29. The other side of the cover assembly likewise is provided with pins 32 which if squeezed together remove pins 29 from their socket and permit rotation of the cover about pivot 31. If both pins 30 and 32 are squeezed together, the entire feed cover assembly 15 is removable.

Figure 4:
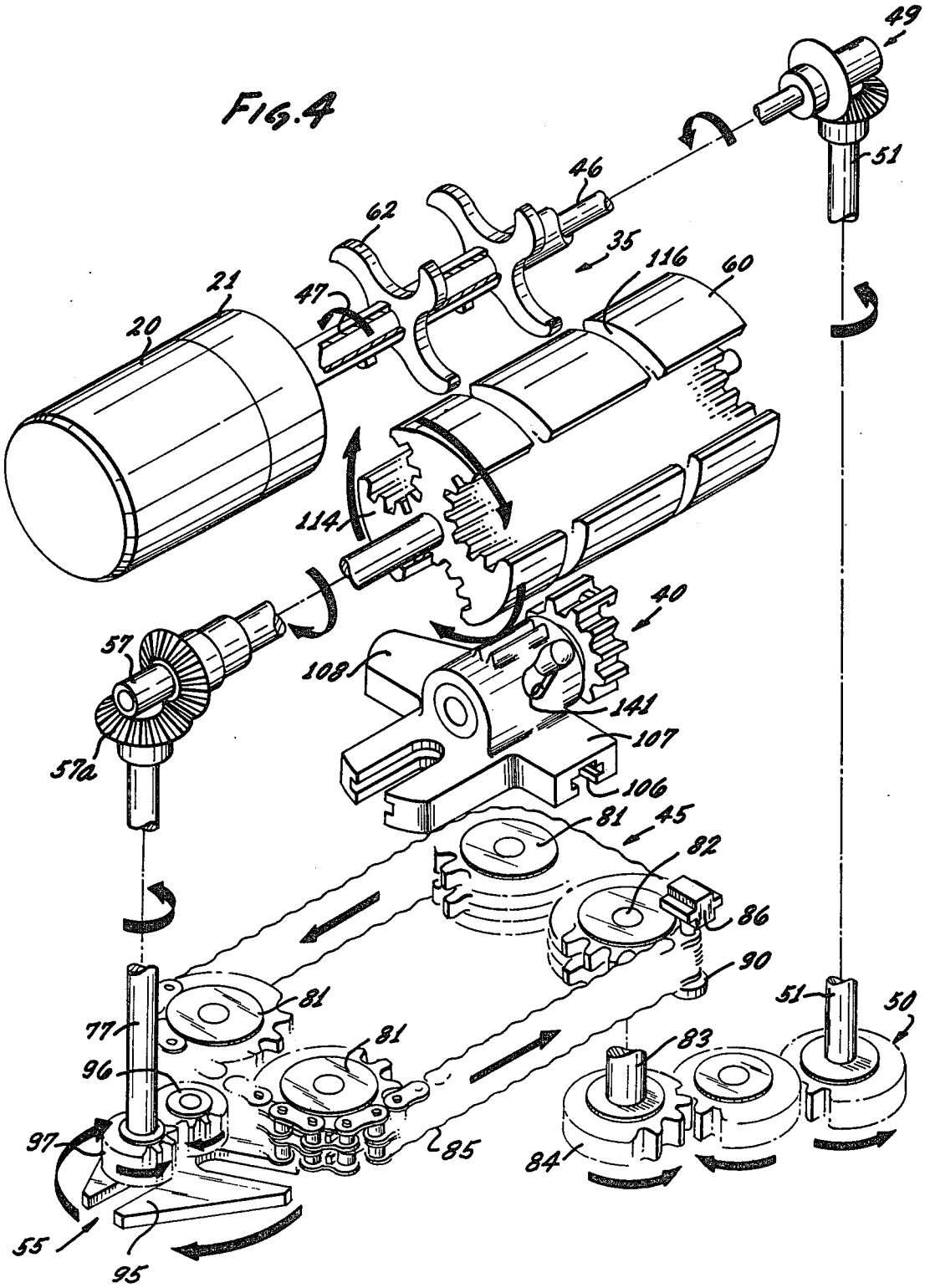
FIG. 4 is a developed, somewhat diagrammatic view of the interior working parts of the gun in accordance with this invention.

The principal functional components of the gun are illustrated in FIG. 4 and include a feeder assembly generally designated 35 which cooperates with a bolt assembly 40, the latter movable by a chain cam assembly generally indicated at 45.

The gear reducer 21 operates to reduce motor output speed by a factor of 2.3 to 1 to drive an inner drive shaft 46, while an outer concentrically arranged output shaft 47 is reduced by a further 16 to 1 ratio. The output of shaft 46 (FIG. 4) is the right angle bevel gear drive 49 having a 1 to 1 ratio, the bevel gears being positioned in housing 23. The shaft 51 of gear set 49 passes through shaft cover 24 to the set of spur gears 50 located in gear housing 25.

A power transmission assembly for the synchronous movement of the various parts includes the motor 20 and gear reducer 21, the output of which drives an inner drive shaft 46 and an outer concentric shaft 47. Shaft 46 drives bevel gear set 49 the output of which drives spur gears 50 through shaft 51. Spur gears 50 form the power source for the chain drive assembly 45 which in turn operates a Geneva gear assembly 55. In this form, the Geneva gear assembly operates as a positively driven intermittent motion device to interface the constant velocity feeding with the intermittent bolt operation.

The output of the Geneva gear assembly operates a second bevel gear set 57, the output of which is connected to a feed rotor 60, the latter part of the feeder assembly. Cooperating with the feed rotor 60 is a feed sprocket generally designated 62, the latter driven by shaft 47.

Figure 5:
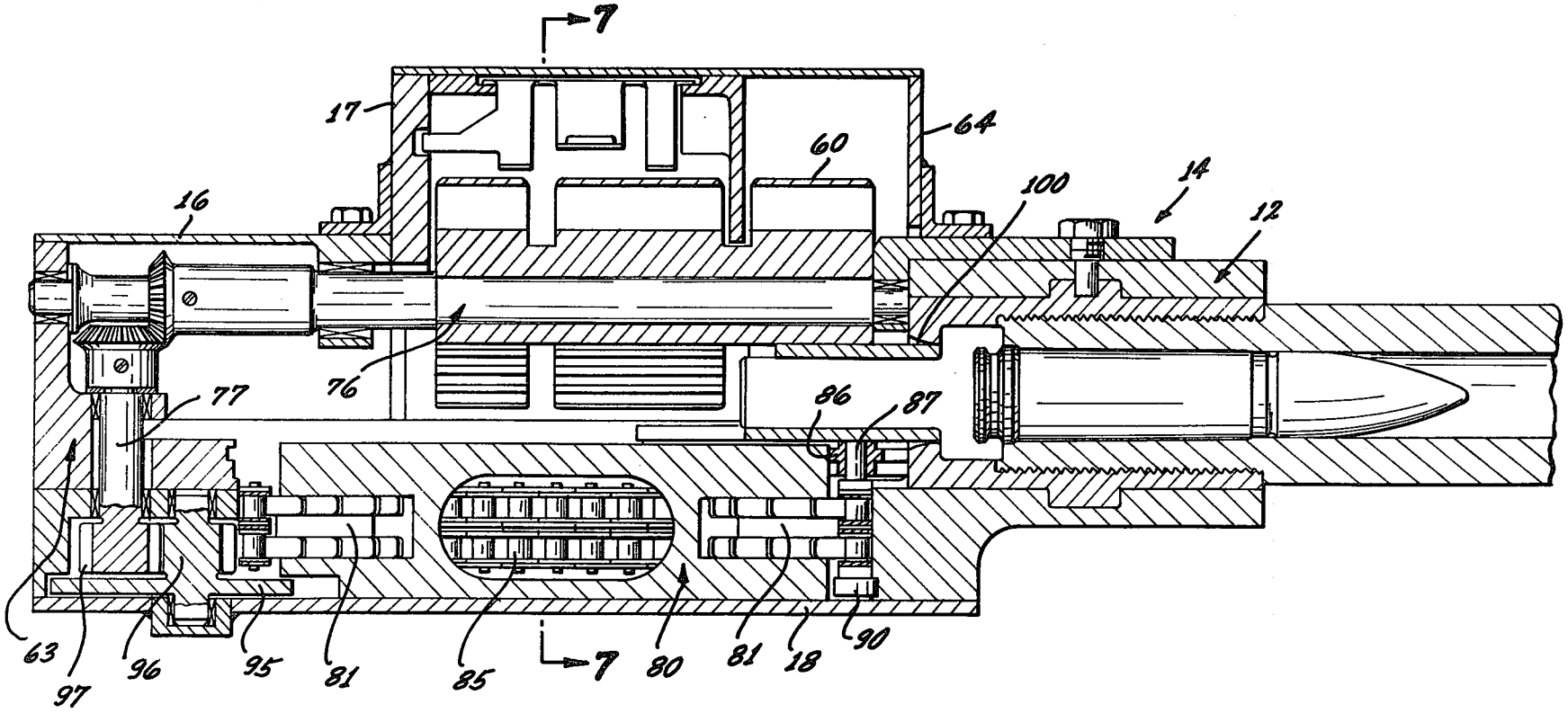
FIG. 5 is a view partly in elevation and partly in section taken along the line 5—5 of FIG. 2.

Referring now to FIG. 5 which illustrates the firing position of the gun 10, back plate 63 cooperates with the bottom plate assembly 18, the receiver 12, top plate 19 and feeder rotor support 14 and the back cover 16 to enclose the interior working mechanism of the weapon. The feed cover assembly 15 includes a front wall 64 secured to the feeder rotor support as indicated, and a rear wall 17 secured to the back cover 16 as indicated.

Figure 6:
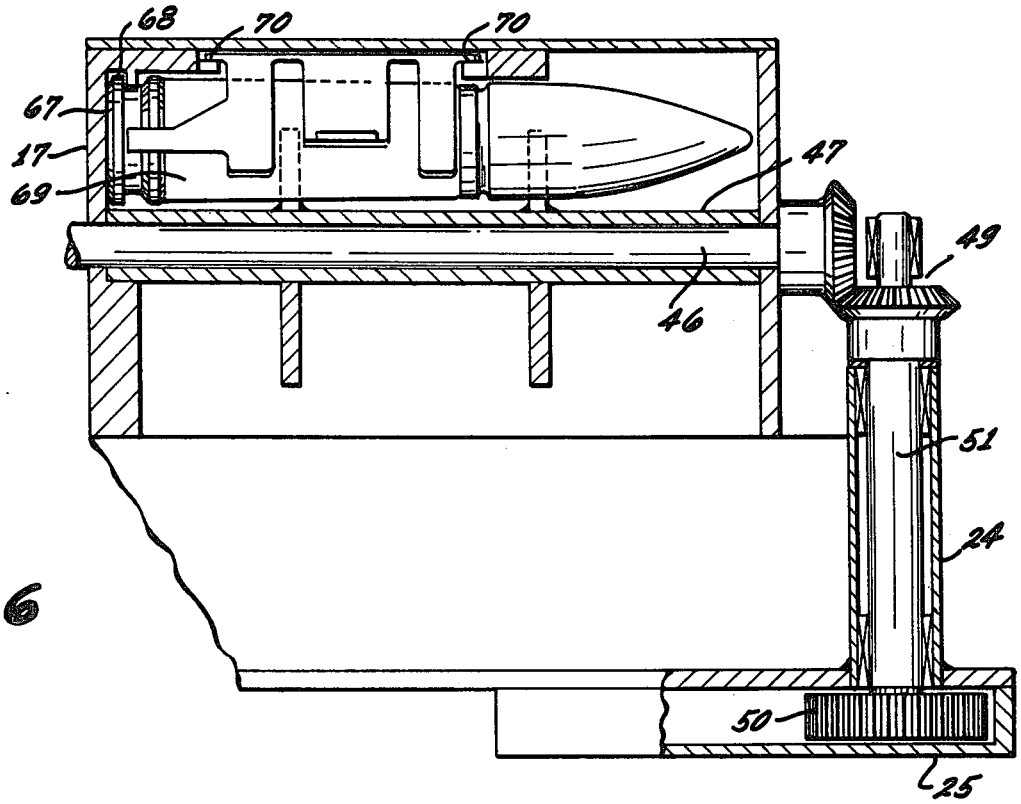
FIG. 6 is a view partly in elevation and partly in section taken along the line 6—6 of FIG. 2.
Figure 7:
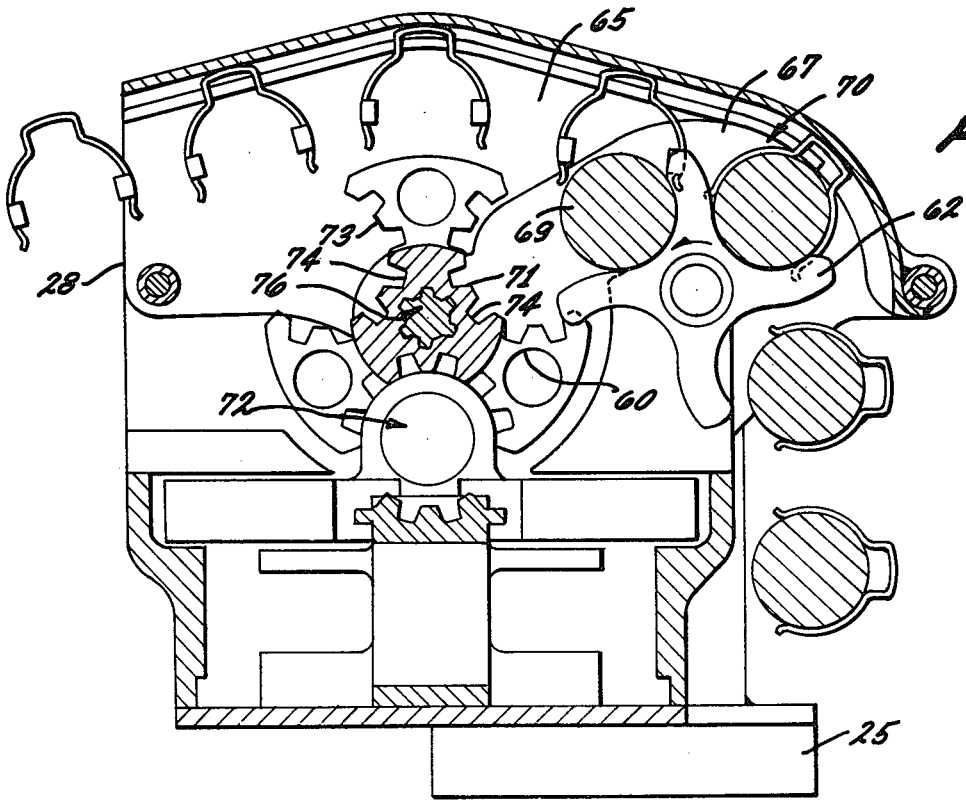
FIG. 7 is a view partly in elevation and partly in section taken along the line 7—7 of FIG. 5.

The outer drive shaft 47 has affixed to it the feed sprockets 62, each having four teeth, as illustrated in FIG. 4, and which operate to advance a round to the feed rotor 60. As shown in FIGS. 5–7 the feed sprockets 62 are spaced from each other and are welded to shaft 47, although other means to affix the sprockets may be used. The sprockets are driven directly by the motor 20 through the gear reducer at a constant velocity.

The rear wall 17 of the feed cover assembly includes an arcuately shaped slot 67 (FIG. 6) proportioned to receive the base 68 of a round 69 and to guide it to the feed rotor 60. As the feed sprockets rotate to feed the belt of ammunition, the round is fed in a path such that strippers 70 (FIGS. 6 and 7) are automatically inserted between the round and the link. The link is guided by the strippers along the cover 15 and out the outfeed side 28 as the stripped round is guided by the feed sprocket and slot to the feed rotor 60.

In the form shown, the ammunition is of the linked type, and loading is accomplished by opening the cover 15 locating the lead round on the feed sprockets 62 with the base 68 in slot 67, and closing the cover. The belt is now supported and feed and fire start promptly upon energizing the gun, as will be disclosed hereinafter. The motor 20 and gearing has sufficient power to advance the belt, it being understood that linkless ammunition systems may be used, if desired.

The feed rotor 60 includes three cavities, 71, 72 and 73, the rotor being stationary as the round is stripped from the belt and placed into one of the cavities of the rotor by feed sprockets 62. As shown, the axial length of the feed rotor 60 is approximately that of the round, while each of the cavities 71–73 has a diameter which basically matches that of the round. Each of the cavities is grooved, as at 74, for cooperation with the bolt assembly 40, as will be described hereinafter.

The feed rotor is splined to a drive shaft 76 (FIGS. 4, 5 and 7), the latter being the output of bevel gear set 57 which has a 1:1 ratio and which turns in the direction indicated in the drawings. Bevel gear 57*a* of the set 57 is connected by shaft 77 (FIG. 5) to the Geneva gear assembly 55, the latter operating in cooperation with the chain drive assembly 45.

The chain drive assembly, which functions as the principal control element for timing and sequence, includes a chain sprocket support member 80 (FIGS. 5 and 8) in which three idler chain sprockets 81 and one drive sprocket 82 are journaled. The drive sprocket is driven by the spur gear assembly 50 (FIG. 4), the drive sprocket being splined to the shaft 83 of the gear 84 of the spur gear set 50, the various gears and sprockets rotating in the direction shown.

Mounted on the sprockets 81–82 is a continuous chain member 85, travelling in a predetermined path in the direction indicated (FIG. 4). In the form shown, the chain is a heavy duty double row type that rides on the sprockets. One link of the chain carries a driven bolt drive shoe 86 mounted through a stud 87 carried by the chain. Directly opposite and below the shoe 86 is a Geneva drive roller 90, also carried by a stud 91 on one link of the chain 85.

A Geneva wheel 95 is located to the rear of the chain 85 and journaled on the bottom plate assembly 18 for rotation (FIG. 5). The Geneva wheel carries a gear 96 in the center of the wheel which meshes with gear 97 affixed to shaft 77, the other end of which carries gear 57*a* of bevel gear set 57. Thus, whenever the Geneva wheel moves, movement is imparted to the feed rotor 60 by the gearing described.

Figure 9:
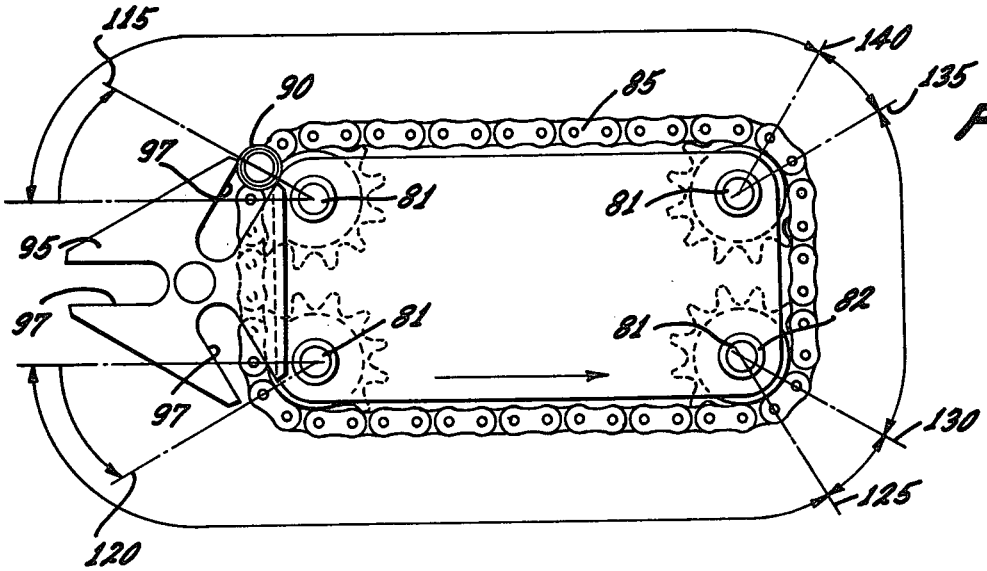
FIG. 9 is a diagrammatic view of the chain drive assembly in accordance with this invention.

The operation of the Geneva wheel assembly 55 may be understood with reference to FIG. 9. The wheel 95 itself has three slots 97 formed therein, arranged at 120° with respect to the center of the wheel. Thus, the Geneva assembly acts as a simple and reliable indexing means for starting a mass from rest, moving it a precise fixed distance, bringing it back to rest, and precisely locating the mass in the rest position. It should be noted, however, that the starting and stopping phase are always accompanied by a shock regardless of the size of the mass.

In the form illustrated, the Geneva assembly, intermittently, but with a smooth sinusoidal motion, rotates the feed rotor 60. The initial movement is slow, but quickly accelerates to a peak and comes to a slow controlled halt. Thus, as roller 90 engages one of the slots 97 of the wheel 95, gear set 96–97 is initially slowly rotated causing the feed rotor 60 to start rotating slowly. As the roller 90 moves from the position illustrated in FIG. 9 to a position between gears 81, the wheel 95 is accelerating. When the roller 90 reaches midway between the gears 81, the velocity of the wheel 95, and thus the feed rotor 60 is at a maximum. As the roller is advanced from the mid-point towards the lowermost gear (marked a), deceleration starts, and finally movement is slowed and stopped as the roller leaves the slot 97. The rotation of the wheel sequentially presents a slot 97 to be picked up by the roller for each revolution of the chain 85.

As the chain moves along its predetermined path of travel, it also controls the function and position of the bolt assembly 40, the latter including a bolt carrier 98 (FIG. 8) and a bolt head 99 which is splined at one end as indicated. The bolt head 99 rotates within the carrier 98 so that as the bolt assembly is moved to the forward battery position, the bolt may be locked to a breech 100 (FIG. 4) which is grooved to receive the splines of the bolt head.

As the splined bolt head enters the grooved breech, the head is advanced sufficiently for the rear face 102 of the splines to clear the forward face of the grooved breech. The bolt head is then rotated, as will be described later, to lock the bolt and the round in the firing chamber. After firing, the bolt head is unlocked and retracted from the battery position.

The bolt assembly moves axially towards and away from the breech on rails 103 formed as part of the chain sprocket support 80. The face of the rail platform 104 is slightly raised above chain sprocket support such that the bolt head and any cartridge or round carried clears the chain 85. The rail platform is grooved at 105 to receive the splined portion of the bolt head. In the reciprocating motion towards and away from the barrel, the bolt assembly travels through one of the cavities 71–73 of the rotor assembly since the splines on the bolt head also fit the grooves 74 of the feed rotor cavities.

The underside of the bolt carrier body includes a cross-shaped bolt drive shoe slot 106 (FIG. 4) arranged transversely of the body and at right angles to the rail platform 104. The bolt drive shoe 86 is received in the slot 106 and forms the driving connection between the bolt carrier body 98 and the chain 85.

In the form shown, the path of travel of the chain 85 is generally rectangular and the bolt drive shoe and slot cooperating with the rails 103 to affect only axial movement of the bolt body 98. The bolt drive shoe 86 is able to rotate on the stud 87 and thus, the shoe travels axially with wing 107 of the carrier body 98 as the latter is advanced to the barrel.

As the shoe moves sideways, along the short leg of the travel of the chain 85, the shoe 86 traverses in the slot 106 from wing 107, across the body 98 to wing 108, following the chain as it continues its path of travel. During the general portion of shoe travel, the bolt head is locked, the gun fired and the bolt head unlocked, as will be described in detail later.

As the shoe 86 reaches idler 81 in its travel along the short leg of the rectangle, the shoe is located in wing 108 of the bolt carrier body. As the chain continues to move, advancing the shoe 86 along the second long leg of the rectangle, the bolt carrier body is withdrawn from the battery position. As the shoe reaches the rearward position, following the continuously moving chain 85, the Geneva drive roller 90 engages one of the slots 97 on the Geneva wheel 95 to effect rotation of the feed rotor 60.

Figure 8:
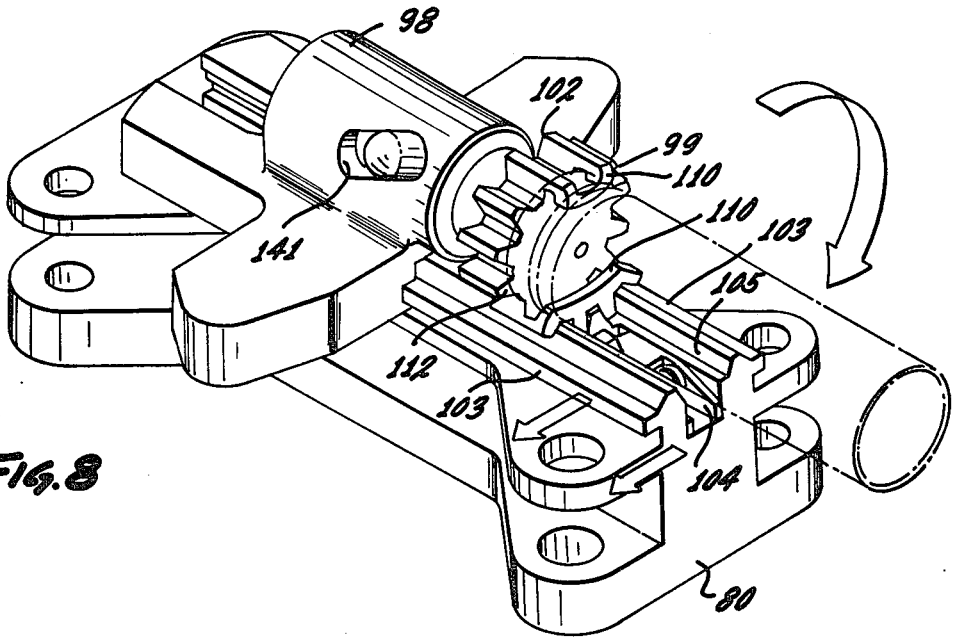
FIG. 8 is a view in perspective of the bolt assembly in accordance with this invention.

Referring now to FIGS. 7 and 8, the bolt head 99 is provided with spaced extractors 110 arranged such that a round may be seated in the bolt head by moving laterally across the face 112 of the bolt head. With the bolt in the rearward position, the face 112 of the bolt is properly aligned behind the rear face 114 of the feed rotor (FIG. 4), to receive a round from the feed rotor 60 which carried the round such that it is fed between the extractors and the bolt face, as illustrated.

Assuming no round is in the gun, but there is a belt loaded on the feed sprocket such that a round is in position for the link strippers 70 to engage a link, and assuming no spent cartridge in the bolt, the bolt is to the rear and the Geneva roller 90 is positioned at 115 (FIG. 9), just short of picking up the available slot of the Geneva wheel. The feed rotor has all three cavities empty and all mechanisms are at rest. At the moment of start-up, the cavity of the feed rotor aligned with the bolt is empty as is the cavity facing the in-feeding sprocket which likewise is free of a round.

Once energized, both the feed sprocket and chain start to move, the rate of travel of the chain being far faster than the rate of rotation of the feed sprocket because of the action of the gear reducer 21. The feed rotor indexes once and simultaneously a round is presented to the available cavity of the feed rotor. The Geneva drive roll 90 is now roughly at position 120 (FIG. 9), and the shoe is positioned in wing 107. The feed sprocket 60 is rotating smoothly and chain is moving continuously, but the bolt is still stationary as is the feed rotor, the latter being notched as at 116 (FIG. 4) to permit the fingers of the feed sprocket to pass through the feed rotor.

At point 120, the bolt body starts forward towards the barrel, absent a round in the extractors. In the forward travel of the bolt, the feed rotor is locked by the bolt body in the cavity through which the bolt is passing. Thus, the Geneva assembly is also locked and remains locked until the bolt body clears the rear face 114 of the feed rotor.

By point 125 the bolt head has cleared the feed rotor, and the rear face 102 has passed into the breech. At this point, the bolt head is starting to rotate to the locked position. Locking is completed by the time the drive shoe 86 reaches point 130 and the firing pin actuates even though there is no round in the chamber. The chain still continues its travel, the feed sprocket is still rotating to present a round to the ready cavity of the feed rotor which is locked in a stationary position by the bolt body.

As drive shoe 86 reaches point 135, it has now traversed from wing 107 to 108 of the bolt body and the unlock sequence now starts and as the bolt is carried rearwardly, the splines on the bolt head now enter the grooves of the cavity with the bolt continuing rearwardly as carried by the shoe and the chain. By this point in the sequence, a round is seated in the ready cavity of the feed rotor and is ready to be transferred to the bolt assembly.

By the time that the shoe reaches point 115, the face 112 of the bolt is to the rear of the rear face of the feed rotor, the projecting portion of the extractors 110 being aligned to receive the in-feeding round. As the extractors clear the feed rotor, the Geneva assembly is ready to start indexing since the Geneva roll is in engagement in one of the slots 97 of the wheel 95. Once the indexing sequence starts, as already described, a round is presented into the extractor and the shoe is approaching point 120. Had there been a casing in the extractors, the rotation of the feed rotor would have kicked the casing out the ejection port 28 during the indexing procedure.

Assuming a firing rate of 750 rpm, the time for one cycle, i.e. feeding and ejecting, ramming, firing and extracting to the start of a second cycle is 0.08 seconds. The second cycle starts at point 115, and the time to fire of the first round is about 0.12 seconds, assuming the starting conditions given.

From the above, several operational advantages appear, for example, dry firing is possible. Misfires in no way effect the cycle, the gun continues to function as if the misfire had been a normal round, and the misfire is ejected the same as a spent cartridge. Ammunition consisting of a dummy in every other round fires at the same rate and in the same time interval as a complement of 100% live rounds. The feed is a constant velocity feed with positive control of the round and positive control during ejecting the spent casing. During the feed, the rim of the case is held in the slot 67 and on the feed sprockets. The rim of the round is controlled continuously and double feeds are not possible.

Since all motions of the gun mechanism are sinusoidal, there are no impacts in start of round transfer or at the end of round transfer. Additionally, the feed rotor is locked by the bolt except during the indexing sequence.

As indicated earlier, the Geneva assembly is an extremely accurate and smooth indexing mechanism. By this invention, the imbalance condition normally associated with this type of indexing is reduced with the result that the load on the chain is balanced because of the relative position of the bolt during Geneva indexing. As the Geneva roller 90 engages the wheel 95 and accelerates the Geneva wheel, the bolt is being decelerated and the two forces are balanced. When the Geneva wheel is being decelerated, the bolt is starting to accelerate forwardly.

Figure 10:
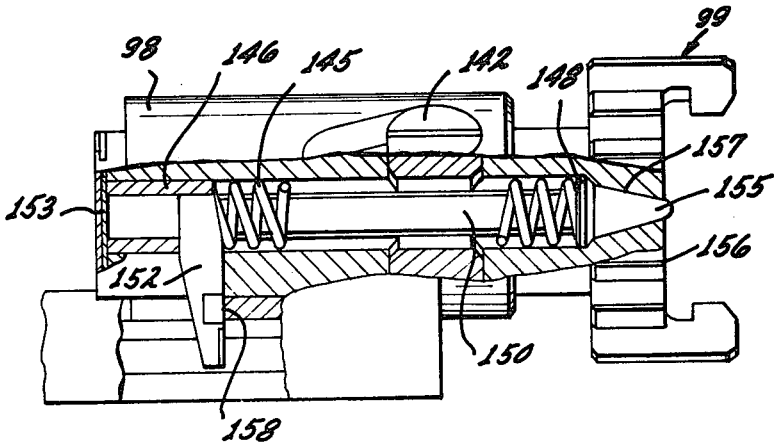
FIG. 10 is a diagrammatic view with a portion thereof broken away of the bolt in accordance with this invention.

Referring to FIG. 10 which shows the details of the bolt assembly 40, the bolt head and body 99 is rotatable within the bolt carrier 98. To affect rotation, the bolt carrier includes a slot 141 (FIG. 8) which receives a cam pin 142 secured to the bolt body 99. The interior of the bolt body receives a firing pin assembly including a firing pin spring 145, one end of which seats against a sleeve 146 and the other end of which abuts a yoke 148. A firing pin 150 passes through the spring 145, the forward end of the pin passing through and carrying the yoke 148.

The firing pin includes a firing pin tang 152, the firing pin assembly being retained within the body 99 by retainer 153. The firing pin tang 152, once engaged, moves rearwardly towards the retainer 153 and the yoke operates to compress spring 145. The firing pin tang is normally in the 5 o'clock position as viewed from the rear.

In operation, as the bolt head 99 passes through the locking lugs in the rear of the barrel and the front face 112 of the bolt seats in the breech, the rear face 102 has entered the breech 100. The bolt carrier 98 is still being advanced by the chain drive, but at a relatively slow rate since the shoe is at a position approximately corresponding to 125 (FIG. 9). The firing pin tang has been engaged by a block in the chain sprocket support to compress the spring 145. As the bolt carrier body continues forward, the bolt cam pin 142 rides in slot 141 rotating the bolt head about 15° clockwise as viewed from the rear to lock the head in the breech. After the head is locked, the firing pin tang rotates off the block to about the 6 o'clock position and snaps forward as locking is completed.

The firing pin head 155, which is tapered and seats in a tapered seat 156, strikes the shell primer for firing. After the primer strikes, the pin moves back such that the pin head does not extend beyond the central face 156 of the bolt body.

During this sequence, the chain is still moving from position 130 to 135 (FIG. 9), and the projectile is traveling out of the barrel. As the shoe reaches point 135, the unlock sequence starts and the bolt carrier body starts rearwardly slowly and the cam pin 142 travels in the slot 141 to rotate the head 15° counterclockwise, as viewed from the rear. At the same time, the firing pin tang which is in the forward position relative to the bolt carrier body is rotated over a spring loaded pawl assembly on the forward end of the chain sprocket support 80 into a safety notch 158, ready for the next cycle.

Figure 11:
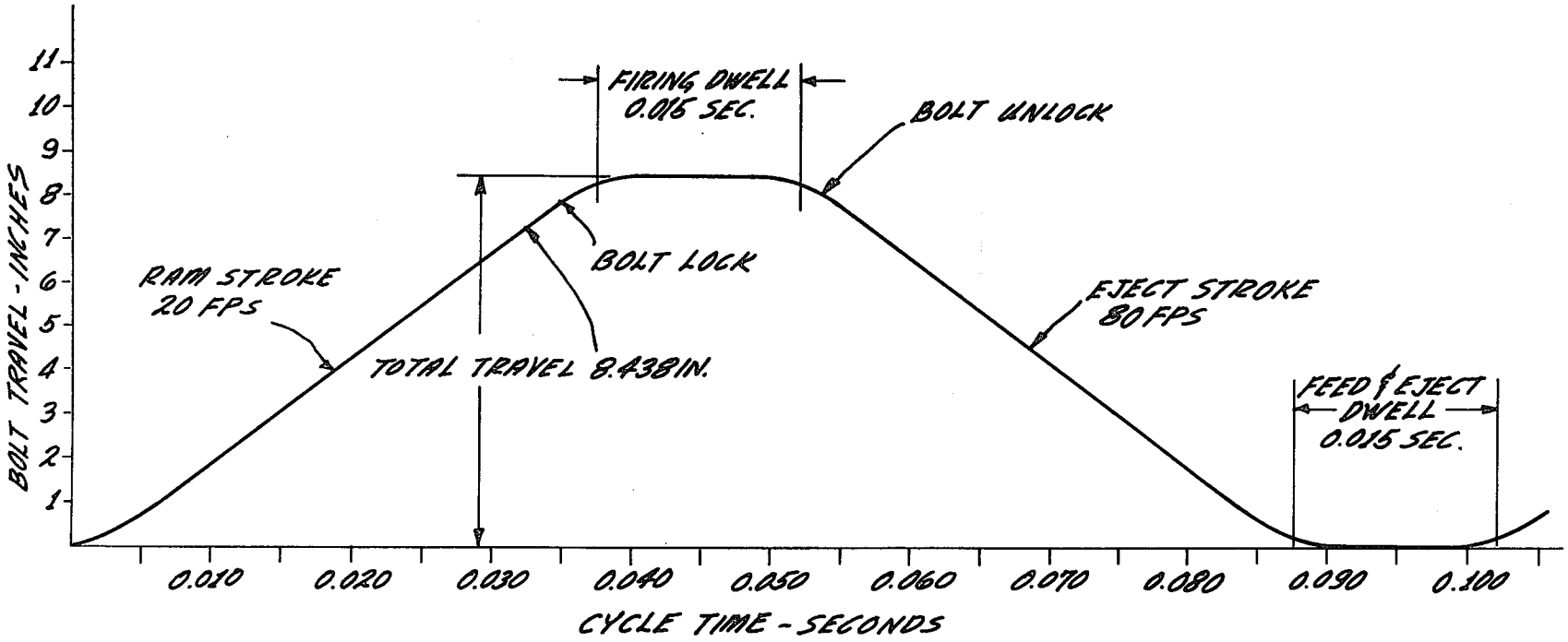
FIG. 11 is a time versus displacement diagram of a gun embodying the principle of the present invention at a rate of 600 shots per minute.

Assuming a 30 mm round, and a nominal rate of 600 rpm, the displacement time relationship is shown in FIG. 11.

The use of a chain drive unit to control timing and sequence lends itself to simplification of the gun structure. In the exemplary embodiment schematically illustrated in FIG. 12, wherein like reference numerals have been used where applicable, the gun structure is modified and simplified somewhat from that previously described to enable use of a positively driven intermittent motion indexing device in the form of a paradromic cam indexing drive mechanism.

Figure 12:
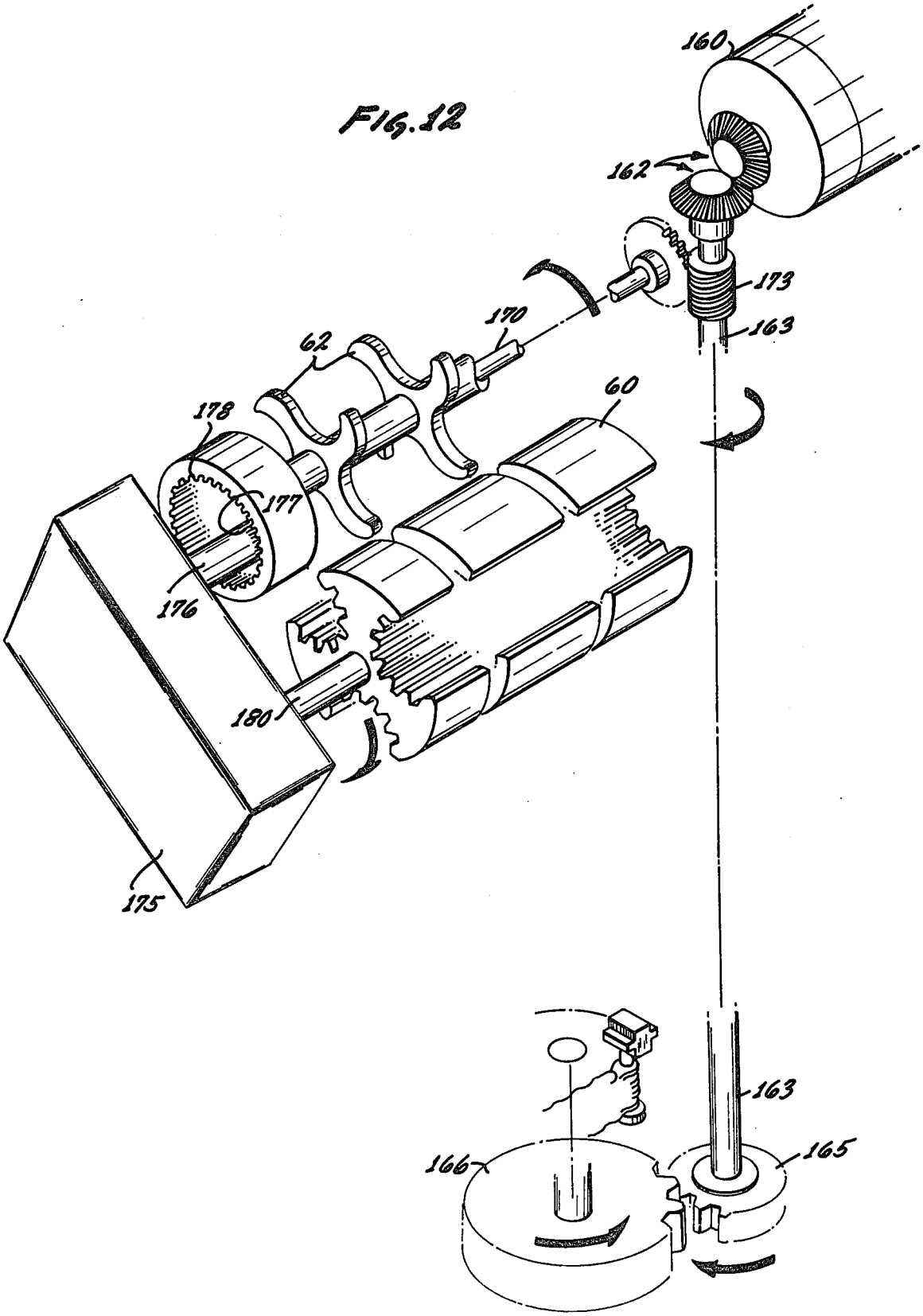
FIG. 12 is a view partly in section and partly in elevation of a modified form of chain gun of the present invention using a parallel index drive assembly.

Referring specifically to FIG. 12, the gun includes a barrel 11 supported within the receiver assembly as already described, the latter including the feed rotor support assembly 60 as described. In this form, a motor 160 is mounted forward of the feed cover assembly, i.e. on the barrel side, the motor operating to provide the primary power and basic timing for the various gun functions and turning in the direction indicated.

As illustrated, the output of the motor is connected through a beveled gear set generally illustrated 162 to a drive shaft 163 in a clockwise direction, as shown. The drive shaft 162 includes a pinion gear 165 at one end thereof cooperating with a bull gear 166, the latter arranged in driving relationship with the drive sprocket for the chain drive assembly already described. The feed sprocket 62 is driven by a shaft 170 the latter in turn being rotated as indicated through a worm gear connection 173 from shaft 163.

Mounted rearwardly of the feed cover assembly 15 is a paradromic cam indexing drive mechanism generally indicated 175. These types of mechanism are well known commercially available units and are sometimes also known in the trade as parallel index drive units. In general operation, the unit includes an input drive shaft carrying cam plates. The cam plates cooperate with an indexing mechanism mounted on the output shaft to effect an indexing action in accordance with the particular functional relationship desired. For additional information regarding paradromic cam indexing drive mechanisms sometimes identified as parallel index drive components, reference is made to U.S. Pat. No. 3,572,173.

The paradromic indexing mechanism 175 is driven by drive shaft 176 the latter having a gear 177 mounted at one end thereof to cooperate with an internal gear 178 fixed to shaft 170, the latter also driving the sprockets 62. The output shaft 180 of unit 175 connected directly to the feed rotor 60 to index the latter in the proper direction and sequence is already described.

As will be apparent, the use of a paradromic indexing unit eliminates the need for a Geneva wheel and driving connection between the chain drive and the gears necessary to interconnect the Geneva assembly to the feed rotor 60. Thus, the use of the paradromic drive mechanism simplifies a number of mechanical components and gears necessary to achieve the function already described.

As a typical example of a suitable paradromic drive assembly, the unit including three stops with a 90° indexing period operates satisfactorily for the design already described. Thus, for each revolution of the drive shaft, the feed rotor 60 is rotated 120°.

In this particular form, the chain drive unit is continuously driven, as described, however there is no interconnection between the chain drive unit to control the operation of the paradromic indexing mechanism, the latter being controlled by drive shaft 176 which is coupled to the motor through the gear set 162, worm gear 173, shaft 170 and gear set 177 and 178.

The motor control system is relatively uncomplicated and includes a master "arm" switch which provides power to the gun system and acts as a master override and safety switch as to all gun functions. The trigger switch actuates the firing sequence i.e. feed and chain drive assembly through the motor 20.

If desired, a magnetic switch may be used to sense the rearward position of the bolt assembly and so control the motor that bolt stops in the rearward position.

As is apparent from the foregoing description, that simplicity in design and operation have been achieved through the novel chain cam assembly which functions as a bolt control mechanism. Both timing and sequence are determined by the path of travel of the chain member and the rate thereof. By use of this novel control system, it is possible to have a sequence of loading, ramming, firing and extracting in a fixed barrel high rate of fire weapon.

The high rate of fire is the result of the advantages of the bolt control mechanism which in effect operates the total gun function. Various portions of the predetermined path of travel define various functions. Thus, by varying the path of travel, other functions may be added, or the timing altered. By continuously advancing the bolt control mechanism, as is done in the present invention, the overall rate of fire may be increased or decreased by varying the rate of travel over any given path. Even when the bolt is stationary, i.e. in the loading and firing portions, the bolt control mechanism continues to move along the path of travel, and thus, inertia-mass problems are reduced.

While the bolt assembly is accelerated and decelerated, the cooperative action of the indexing mechanism operates to counterbalance the "shock" normally expected. Moreover, the lock and unlock sequence are during periods of deceleration and acceleration of the bolt assembly and thus the motion is smooth. Essentially, the same bolt control mechanism is operative to feed rounds sequentially to the bolt by energizing the indexing mechanism which likewise has a sinusoidal rate of movement.

Due to the simplicity of the present system and method, various modifications may be made in the time sequence for the various gun functions by changing the path of travel of the chain assembly and the distance between sprockets and the diameter of the sprockets. Depending upon the arrangement, a single or multiple barrel gun may be readily designed due to the simplicity of the chain cam assembly and the Geneva wheel controlled or paradromic index controlled feed rotor. As is apparent, time systems may be operated off a common motor with separate chain cam assemblies and a common feed rotor assembly including a Geneva wheel or paradromic indexing system driven directly by the power transmission system. In this form the rate of fire is about 2000 rpm.

Another modification includes feeding in which an option is offered of high explosive or armor piercing ammunition, for example. By selecting one of two modes with a single barrel gun, one or the other type of ammunition may be fed to the feed rotor. Basically the same sequence is carried out by the chain cam assembly and Geneva drive wheel or the paradromic indexing system.

Simplification of the gun structure by use of a parallel index drive mechanism enables the use of forced ejection system in which the spent casing, or misfired round is ejected through a port which may be located below the feed rotor and to the right thereof, as viewed from the rear. An ejection arm mounted for movement with the bolt operates to force the spent casing forwardly and away, a definite advantage for weapons having a rate of fire of the gun here described.

The positive control of the round also offers the advantage of considerable versatility in the types of casings, that is, brass, steel and aluminum-cased ammunition all handled with equal facility.

As is apparent, the relative simplicity of the four basic assemblies of the rapid fire gun of the present invention offer considerable latitude in timing of gun functions, feed and bolt movement. Two feed belts on a single barrel may be used, or a single belt for a two barrel weapon, or two belts feeding two barrels. The reciprocating parts are generally lightweight, i.e. the bolt assembly and this enables wide variation and better control of timing functions.

While the present invention has been described with reference to the form illustrated, it will be apparent to those skilled in the art that various changes may be made to the apparatus shown and claimed herein, and it is recognized that this invention may be variously embodied by modifications, substitutions and changes without necessarily departing from the spirit and scope of the present invention as set forth in the accompanying claims.

I claim:

1. An externally powered gun mechanism capable of a high rate of fire comprising a supporting receiver structure carrying at least one gun barrel in fixed stationary relation to the supporting receiver structure, at least one driven bolt assembly movable in reciprocating motion towards and away from the associated gun barrel, at least one drive chain drive assembly mounted on said supporting structure and continuously operating during a firing cycle to advance the cooperating bolt assembly through a cycle of feeding, ramming, firing, extracting, and ejecting, a driven feeder assembly cooperating to feed rounds to said bolt assembly and for ejecting the spent casing, means forming a power transmission system for driving said chain drive assembly and for driving said feeder assembly in synchronism with said chain drive assembly;

said chain drive assembly including means carried thereby and driven along a predetermined path of travel which includes portions defining the timing and sequence of the cycle of feeding, ramming, firing, extracting and ejecting; and said means which are driven along said predetermined path being in engagement with said bolt assembly during travel along said predetermined path and being operative to effect reciprocation of said bolt assembly.

2. A gun mechanism as set forth in claim 1 wherein said chain drive assembly includes a continuous chain member, means to support and to drive said chain through a predetermined path of movement, and said means driven along said predetermined path of travel being carried directly by said chain member to advance said bolt assembly towards and away from said barrel.

3. A gun mechanism as set forth in claim 2 wherein said predetermined path includes portions defining the feeding and ejecting, loading, firing and extracting components of said cycle.

4. A gun mechanism as set forth in claim 2 wherein said chain member carries means to actuate said feeder means as said bolt assembly is positioned to receive a round from said feeder means.

5. A gun mechanism as set forth in claim 3 wherein the time interval for each of the components of said cycle is dependent on the rate and length of travel of said chain and said means carried by said chain along said predetermined path.

6. A gun mechanism as set forth in claim 3 wherein said chain member cooperates with said bolt assembly to reduce the rate of travel during said loading component, maintain said bolt assembly stationary during said firing component, and gradually increase the rate of travel of said bolt assembly during the extraction component of said cycle.

7. A gun mechanism as set forth in claim 1 wherein said feeder assembly includes means forming a feed rotor, in-feed means driven by said power transmission, and indexing means cooperating with said power transmission to index said feed rotor means to receive a round from said in-feed means to feed said round to said bolt assembly.

8. A gun mechanism as set forth in claim 3 wherein the loading component includes advancing the round and locking the bolt assembly, and said extracting component includes unlocking said bolt assembly and removing the spent round.

9. A gun mechanism as set forth in claim 1 wherein said power transmission means continuously drives said chain drive assembly.

10. A gun mechanism as set forth in claim 1 wherein said feeder assembly includes feed sprocket means and a feeder rotor assembly, said feed sprocket means being operative to place a round into said feed rotor assembly, means cooperating with chain drive assembly to effect movement of said feed rotor assembly to place a round in said bolt assembly and simultaneously to remove a spent casing therefrom.

11. A gun mechanism as set forth in claim 10 wherein said power transmission means effects continuous movement of said feed sprocket means, and wherein said feeder assembly includes indexing means to rotate said feed rotor assembly as said bolt assembly is positioned in the rearmost position relative to said barrel.

12. A gun mechanism as set forth in claim 1 wherein said chain drive assembly is mounted rearwardly of said barrel, said bolt assembly being mounted for cooperation with said chain drive assembly and driven thereby in a reciprocating movement towards and away from said barrel, said feeder assembly including a feed rotor assembly and feed sprocket means, said feed rotor including multiple chambers to receive a round from said feed sprocket means and to eject a spent casing, and said feed rotor means being mounted such that one of said chambers is in alignment with said bolt assembly during movement of the latter towards and away from said barrel.

13. An externally powered gun mechanism as set forth in claim 1 wherein said driven feeder assembly includes a continuously driven feed sprocket and an associated feed rotor, and indexing means cooperating with said chain drive assembly for intermittently indexing said feed rotor in synchronism with the movement of said feed sprocket and said bolt assembly to sequentially present a round to said bolt assembly.

14. An externally powered gun mechanism as set forth in claim 1 further including indexing means cooperating with said chain drive assembly and controlling the feeder assembly to sequentially present a round to said bolt assembly.

15. An externally powered gun mechanism capable of high rate of fire up to about 1000 rounds per minute through a cycle of feeding and ejecting, ramming, firing and extracting, comprising a supporting receiver structure carrying at least one gun barrel in fixed relation to the supporting receiver structure, at least one bolt assembly movable relative to the associated gun barrel, at least one bolt control assembly means cooperating with said bolt assembly to effect movement thereof towards and away from the associated barrel and to maintain said bolt assembly stationary during firing, means continuously driving said bolt control assembly in a planar predetermined path of travel, said bolt control assembly including a plurality of elements supported in spaced relation and supporting a member movable along said planar predetermined path of travel in one direction to control the timing and sequence of said cycle, said elements being rotatable elements arranged in a generally rectangular orientation, continuously driven and intermittently operable means for feeding ammunition to said bolt assembly, means to actuate said ammunition feed means in synchronism with the position of said bolt assembly;

drive means operatively associated with at least one of said plurality of elements and said continuously driven means to drive the same; and means carried by said member and connected directly to said bolt assembly and in engagement therewith as said bolt assembly is moved.

16. A gun mechanism as set forth in claim 15 wherein said bolt control assembly includes means movable in a predetermined path different from the path of travel of said bolt assembly, said movable means operative to define a firing cycle including loading, ramming, firing and ejecting, and said predetermined path including portions defining each component of said firing cycle.

17. In a rapid fire, externally powered gun having at least one fixed barrel mounted in fixed relation to a supporting receiver structure and feed means to present a round sequentially to a cooperating bolt assembly reciprocally movable relative to the associated barrel, the improvement comprising a control assembly including spaced rotatable support means and means carried by said support means continuously advanceable in one direction along a predetermined rectangular path of travel, the path of travel of said control assembly being operative to define the sequence and timing of loading, ramming, firing and ejecting, means continuously driving said continuously advanceable means along said path of travel, feed means including a driven feeder assembly and intermittently operable rotor means, indexing means cooperating with said control assembly for synchronized intermittent operation of said rotor means; and said means carried by said support means including a member carried thereby and directly connected to said bolt assembly to effect movement of said cooperating bolt assembly.

18. A rapid fire gun as set forth in claim 17 wherein said continuously advanceable means is operative in cooperation with said feed means to present a round sequentially to the associated bolt assembly, and wherein said bolt assembly is constructed and arranged to be maintained stationary relative to the associated barrel during the period of firing of a round while said advanceable means is continuously moving.

19. An externally powered gun as set forth in claim 17 wherein said indexing means is a parallel index drive mechanism.

20. The method of controlling the sequence and timing of an externally powered weapon wherein said sequence includes the operations of ramming, firing, extracting and loading, and wherein said weapon includes a barrel, a bolt assembly and a feed assembly, the method comprising the steps of providing a control assembly including a driven member, continuously advancing said driven member along a predetermined generally rectangular path of travel in one direction, said path of travel including portions defining the sequence and time of the operations of ramming, firing, extracting and loading, maintaining said bolt assembly in direct and continuous contact with said continuously advancing driven member throughout said sequence, said bolt assembly in driving contact with said driven member being stationary during loading and firing operations while said driven member is continuously advanced along said predetermined path of travel, sequentially indexing a round to said bolt assembly during the loading operation as controlled by the relative position of said driven member along the path of travel, and the rate of travel and the length of the path of travel of said driven member determining the time interval of each of said operations.

21. The method as set forth in claim 20 wherein said bolt assembly reaches a maximum rate of travel during ramming and extracting.

22. The method as set forth in claim 20 further including the steps of continuously feeding rounds at a rate less than the rate of travel of said driven member such that a round may be sequentially indexed to said bolt assembly.

23. A powered gun mechanism capable of rapid fire comprising:

means forming a supporting structure, at least one gun barrel cooperating with said supporting structure and supported thereby, said gun barrel having a chamber cooperating therewith to receive a round to be fired, means forming at least one bolt assembly cooperating with said gun barrel, at least one chain drive assembly mounted on said supporting structure to effect relative motion between said bolt assembly and said gun barrel, said chain drive assembly cooperating with said bolt assembly and said gun barrel to control the sequence of a firing cycle including at least positioning a round in said chamber for firing the round, said chain drive assembly including means carried thereby and moveable therewith and directly coupled to said bolt assembly to effect movement thereof relative to said gun barrel, means forming a feeder assembly to provide a round to be positioned in said chamber, and means forming a power drive system for driving said chain drive assembly and for driving said feeder assembly in synchronism with said chain drive assembly.

24. A powered gun mechanism as set forth in claim 23 wherein said chain drive assembly is operative to effect movement of said bolt assembly in a reciprocating fashion.

25. A powered gun mechanism as set forth in claim 23 wherein said means forming a drive system continuously drives said chain drive assembly and the means carried thereby.

26. A powered gun mechanism as set forth in claim 23 further including external power means continuously driving said drive system, and said drive system including means continuously driving both said chain drive assembly and said feeder assembly.

27. A powered gun mechanism as set forth in claim 25 wherein said chain drive assembly is operative to effect movement of said bolt assembly, and said gun barrel being so mounted on said supporting structure that the barrel is stationary relative to said supporting structure at least prior to firing a round and subsequent to firing a round.

28. A powered gun mechanism comprising a supporting structure, at least one gun barrel mounted on said supporting structure and including a chamber receiving a round to be fired, at least one bolt assembly mounted on said supporting structure, means to effect relative movement between said bolt assembly and said gun barrel, said means effecting relative movement including a plurality of spaced rotatable support elements disposed in planar orientation and means carried by said support elements and advanceable along a predetermined planar path of travel which defines a firing sequence including introducing a round in said chamber, and a dwell for firing the round during which said bolt assembly and gun barrel are stationary with respect to each other, said means carried by said support elements including a member moveable along said path of travel and directly and continuously connected to said bolt assembly, means for driving said advanceable means along said path of travel, and feed means operative in synchronism with said advanceable means to present a round for insertion into said chamber.

29. A powered gun mechanism comprising at least one gun barrel, means to support said gun barrel, a bolt assembly cooperating with said gun barrel, means forming a chain driving assembly cooperating with said gun barrel and bolt assembly to effect relative movement therebetween, said chain drive assembly including support elements and a member carried by support elements and movable relative thereto along a predetermined path in one direction which defines a firing sequence including at least positioning a round to be fired, a dwell period during firing, and extracting the spent casing after a round is fired, said member carried by said support elements including means carried thereby and directly connected to said bolt assembly to effect movement thereof, means to drive said chain drive assembly such that there is relative motion between said bolt assembly and gun barrel during positioning a round to be fired and extracting a spent casing after a round is fired, and means to drive said feeder means in synchronism with said chain drive assembly.

30. A powered gun mechanism as set forth in claim 29 wherein said means to drive said chain drive assembly continuously drives the same to effect continuous movement of said member.

31. A powered gun mechanism as set forth in claim 29 wherein said bolt assembly is movable relative to said gun barrel and is maintained stationary relative to said gun barrel during said dwell period.

32. A powered gun mechanism as set forth in claim 29 further including indexing means cooperating with said chain drive assembly and said feeder means for sequentially presenting a round from said feeder means for positioning the round to be fired.

33. A rapid fire gun comprising at least one gun barrel and a chamber associated therewith to receive a round to be fired, at least one bolt assembly cooperating with said gun barrel, at least one chain drive assembly cooperating with said bolt assembly and said gun barrel for effecting relative movement between said bolt assembly and said gun barrel, said chain drive assembly including a plurality of supporting elements arranged in a predetermined orientation and a member driven by said supporting elements through a predetermined path of travel defining and controlling the sequence of a firing cycle including feeding, ramming, firing, extracting, and ejecting a spent casing, said member driven by said supporting elements including means carried thereby and directly and continuously connected to said bolt assembly to effect movement thereof and to maintain said bolt assembly stationary during firing and feeding, feed means cooperating to present a round for a firing cycle, and power means for driving at least said chain drive in one direction.

34. A gun comprising:

at least one gun barrel;

a gun bolt;

a chain drive operating mechanism effecting relative reciprocal motion between said gun bolt and said barrel;

means for feeding rounds of ammunition to said gun bolt;

means carried by said operating mechanism for movement therewith and directly and continuously connected to said gun bolt;

said feeding means including a first and second rotatable transfer means, said first rotatable transfer means being operative to feed a series of rounds sequentially to said second rotatable transfer means, said second rotatable transfer means being operative to receive a round of ammunition from said first rotatable transfer means and for translating said round transversely to the face of said gun bolt, and said operating mechanism and said means carried thereby cooperating with said gun bolt to maintain said gun bolt stationary as said gun bolt receives a round of ammunition from said second rotatable transfer means and to maintain said gun bolt stationary as a round is fired.

35. A gun as set forth in claim 34 wherein said chain drive operating mechanism is an endless chain member, said means carried by said operating mechanism having a forward and rearward compartment of travel and lateral components of travel, and said lateral components of travel defining the interval during which said gun bolt is stationary.

36. A gun as set forth in claim 35 in which said first rotatable transfer means is continuously driven at a uniform rotational velocity and said second rotatable transfer means is driven at a non-uniform rotational velocity.

37. A gun as set forth in claim 35 wherein one of said lateral components of travel represents the interval during which a round is received by said gun bolt, said forward component of travel representing advancing said gun bolt and a round carried thereby to said barrel, the other of said lateral components of travel representing at least the interval during which a round is fired, and said rearward component of travel representing rearward advance of a spent casing.

38. A gun as set forth in claim 34 further including external power means to drive said operating mechanism and said means for feeding rounds.

39. A gun as set forth in claim 38 further including indexing means for rotating said second rotatable transfer means.

40. A gun as set forth in claim 37 further including indexing means, and said indexing means being operative during said one of said lateral components of travel to effect rotation of said second rotatable transfer means.

41. A bolt control assembly for a gun in which a bolt assembly is movable in a reciprocating manner between a rear position and a forward position, comprising:

a driven chain drive assembly continuously movable during a firing cycle to advance the bolt assembly through a cycle of feeding, ramming, firing, extracting and ejecting;

said chain drive assembly including means driven along a predetermined path of travel which includes portions defining the timing and sequence of the cycle of feeding, ramming, firing, extracting and ejecting; and means connected to and carried by said chain drive assembly and driven along said predetermined path of travel and connected directly to said bolt assembly to effect reciprocating movement thereof.

42. A bolt control assembly for a gun as set forth in claim 41 wherein said chain drive assembly includes:

means spaced in a predetermined geometric pattern and supporting a chain member for movement along said predetermined path;

said means carried by said chain drive assembly being driven by said chain member to reciprocate said bolt assembly between said positions.

43. A bolt control assembly for a gun as set forth in claim 42 wherein the time intervals of the components of said cycle are dependent upon the rate and length of travel of said chain along said predetermined path of travel.

44. A bolt control assembly for a gun as set forth in claim 41 wherein:

said predetermined path of travel is such that during feeding and firing said bolt assembly is stationary while said chain drive assembly is continuously moving to effect continuous movement of said means carried by said chain drive assembly.

45. A bolt control assembly for a gun as set forth in claim 41 wherein said predetermined path of travel includes a path of travel of said means transverse to the direction of the reciprocating travel of said bolt assembly; and said transverse direction of movement of said means corresponding to positions of said bolt assembly when the latter is stationary.

46. A bolt control assembly for a gun as set forth in claim 41 wherein said chain drive assembly includes a plurality of elements supported in spaced relation and supporting said means driven along said path of travel; and said means driven along said path of travel being movable in one direction to control the said timing and sequence.

47. A bolt control assembly for a gun as set forth in claim 46 wherein said elements are rotatable and are arranged in a generally rectangular orientation.

* * * * *